United States Patent [19]

McClure

[11] 4,064,936

[45] Dec. 27, 1977

[54] CHEMICAL TREATING SYSTEM FOR OIL WELLS

[76] Inventor: L. C. McClure, P.O. Box 505, Midland, Tex. 79701

[21] Appl. No.: 704,076

[22] Filed: July 9, 1976

[51] Int. Cl.[2] ..... E21B 3/03

[52] U.S. Cl. ..... 166/75 R; 166/268; 137/205

[58] Field of Search ..... 166/75, 244 C, 64, 68, 166/54; 137/268, 205; 222/226, 71, 72; 210/198 R; 175/206

[56] References Cited

U.S. PATENT DOCUMENTS

| | | | |
|---|---|---|---|
| 2,773,551 | 12/1956 | Warden et al. | 166/75 |
| 2,815,078 | 12/1957 | Reynolds | 166/244 C X |
| 2,884,067 | 4/1959 | Marken | 166/54 X |
| 3,053,320 | 9/1975 | Steincamp | 166/75 X |
| 3,710,867 | 1/1971 | Bansbach | 166/75 X |
| 3,968,932 | 7/1976 | Kimmell | 137/268 X |

*Primary Examiner*—Ernest R. Purser
*Assistant Examiner*—Richard E. Favreau
*Attorney, Agent, or Firm*—Clarence A. O'Brien; Harvey B. Jacobson

[57] ABSTRACT

A chemical treating system for oil wells in the form of a chemical injector and well manifold for protecting down hole oil well equipment from corrosion by injecting a predetermined quantity of chemical additive into a circulating fluid. The equipment includes a supply tank or reservoir supported in elevated position above a calibrated measuring container which discharges into a mixing vessel communicated with pipes connected with the tubing and casing respectively of an oil well with valving arrangements being provided to enable the chemical additive to be injected into a circulating fluid and circulated through the tubing and casing and any down hole equipment associated therewith for a desired period of time.

9 Claims, 7 Drawing Figures

CHEMICAL TREATING SYSTEM FOR OIL WELLS

BACKGROUND OF THE INVENTION

1. Field of the Invention

The present invention generally relates to oil well equipment and more particularly a system including an apparatus for introducing chemical additives to a circulating fluid associated with a well casing and tubing for circulation of the additive through down hole oil well equipment such as pumps and the like.

2. Description of the Prior Art

Most oil operators find it necessary to protect down hole euipment by use of a chemical additive. Usually, a down hole corrosion problem exists which is treated by adding chemicals in one manner or another. The addition of chemicals usually requires the service of specialists who, upon request, bring chemcals and trained employees to a well site with the necessary circulating pumps and the like being connected with the well and operated for a specified time. This operation is quite costly and sometimes the organization supplying such servies is incapable of supplying the chemical additive service when desired. Various efforts have been made to provide fluid injection apparatuses for treating wells in the form of a permanent or semi-permanent installation at each well site. The following U.S. patents are exemplary of the developments in this field:

| | | |
|---|---|---|
| 656,466 | J. C. Minor | Aug. 21, 1900 |
| 2,815,078 | O. B. Reynolds | Dec. 3, 1957 |
| 2,884,067 | A. S. Marken | April 28, 1959 |
| 3,053,320 | S. B. Steincamp | Sept. 11, 1962 |
| 3,228,472 | B. J. Rhoads, Jr. | Jan. 11, 1966 |
| 3,710,867 | Paul L. Bansbach | Jan. 13, 1971 |
| 3,901,313 | T. M. Doniguian et al | Aug. 26, 1975 |

SUMMARY OF THE INVENTION

An object of the present invention is to provide an oil well treating system employing readily available components which may be very easily installed in position for use in remote relation to the well head and can be just as easily related to a new well or an old well with the installation away from the well head reducing danger to employees and the intallation at the well site enabling the normally present employees of the oil well operator to employ the treating system by accurately measuring a desired quantity of chemical additive and injecting it into a circulating fluid.

Another object of the invention is to provide a treating system adapted for various installations in which the apparatus serves as a well manifold and includes the capability of continuous monitoring of pressure in the casing and production tubing string.

A further object of the invention is to provide a treating system in accordance with the preceding objects which includes a relatively simple measuring assembly communicated with a supply reservoir and a mixing vessel which is not only inexpensive but safe in operation and capable of installation in various systems such as where chemical pressure pumps are utilized.

Still another important object of the invention is to provide an oil well treating system and apparatus in which a predetermined quantity of chemical additive may be injected into a circulating fluid which can be circulated through the oil well for a predetermined period of time as determined by the conditions prevalent in the particular well with which the equipment is associated.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
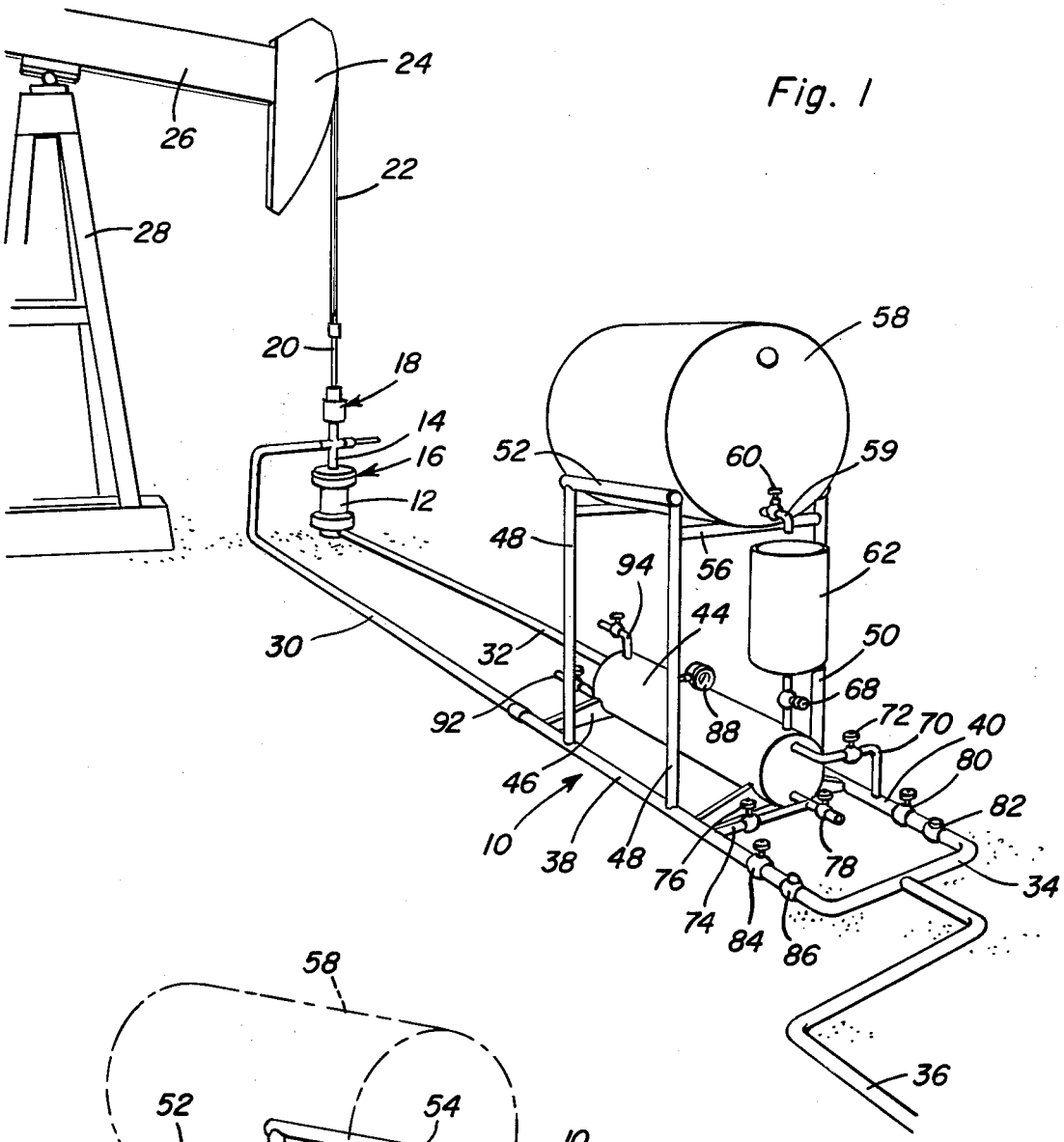
FIG. 1 is a perspective view illustrating the well treating system of the present invention associated with a typical oil well.
Figure 2:
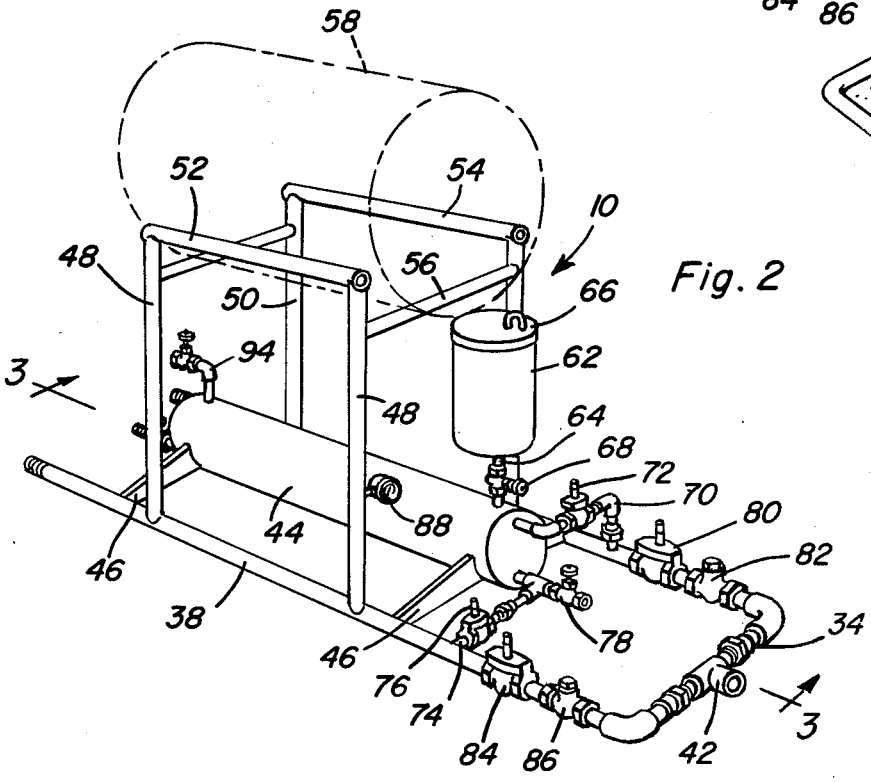
FIG. 2 is a perspective view of the specific structure of the measuring container, mixing vessel and associated pipes and valves adapted to be communicated with an oil well and provided with a supply tank or reservoir which may be in the form of a conventional drum.
Figure 3:
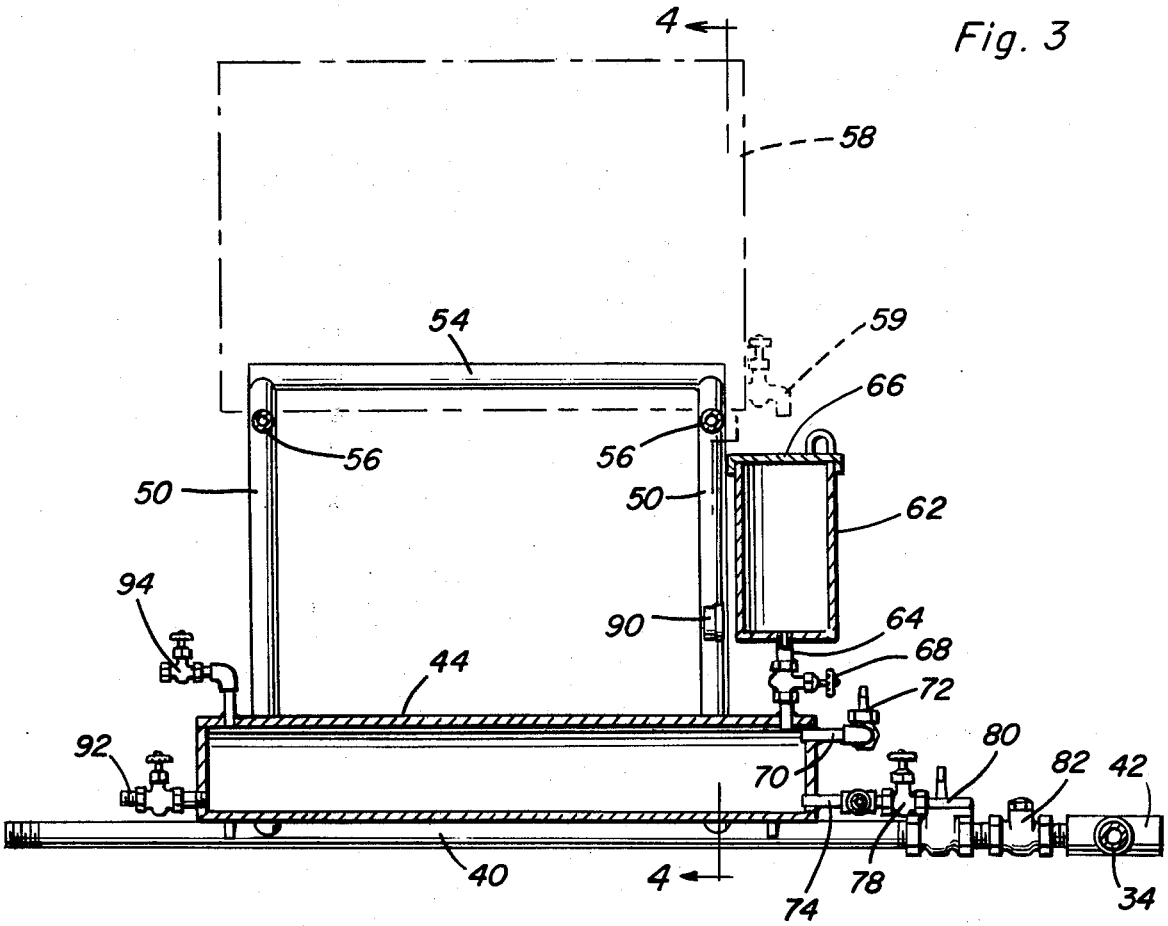
FIG. 3 is a longitudinal, sectional view taken substantially upon a plane passing along section line 3—3 of FIG. 2 illustrating further structural details of the structure of the present invention.
Figure 4:
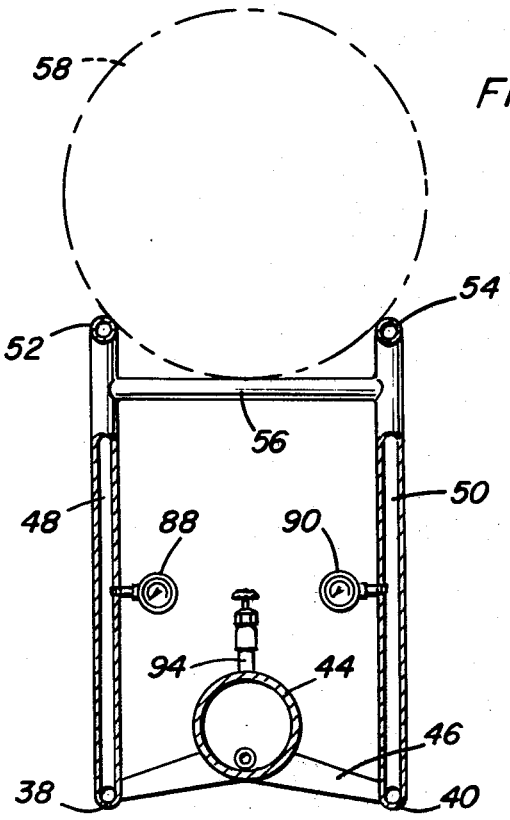
FIG. 4 is a transverse, sectional view taken substantially upon a plane passing along section line 4—4 of FIG. 3 illustrating further structural details of the equipment.
Figure 5:
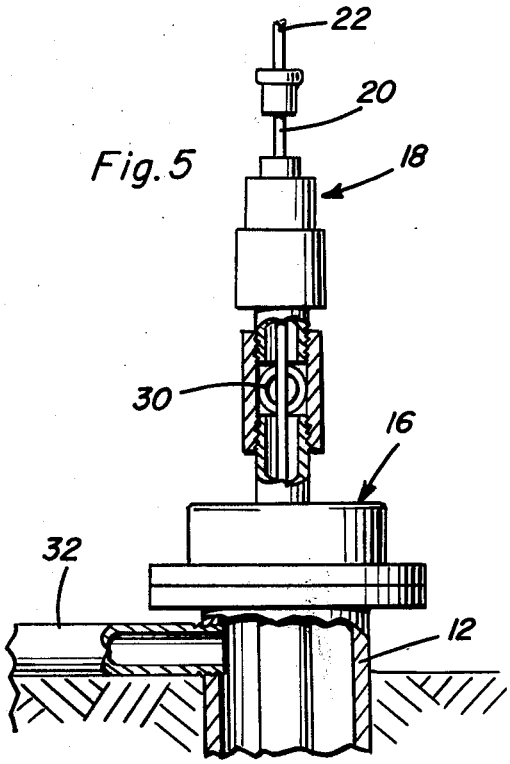
FIG. 5 is a fragmentary elevational view, with portions and sections, illustrating the oil well assembly and the pipes connected thereto.

FIGS. 1 and 5 illustrate the association of the treating system of the present invention which is generally designated by the numeral 10 associated with a conventional oil well in which a casing 12 is associated with a bore hole in a conventional manner such as by being cemented in place. Disposed in the casing 12 is a production tubing string 14 extending upwardly through a well head assembly 16 and provided with a stuffing box 18 at the upper end thereof which reciprocally seals and receives a reciprocal pump rod or polish rod 20 that is reciprocated by a wire rope bail 22 connected to the usual horsehead 24 at one end of a walking beam 26 supported by a stanchion 28 with the other end of the beam 26 being oscillated in a well known manner. The structure of the oil well and mechanism for operating the down hole pump (not shown) is conventional and forms no part of the present invention except for the manner in which the treating system 10 of the present invention is associated therewith. The oil well production tubing string 14 is communicated with a pipe 30 or production flow line which conveys production fluid from the well to a separator, tank or other pipe line.

The present invention includes the use of a pipe 32 communicated with the casing 12 and extends generally in parallel relation to the pipe 30 with the pipes 30 and 32 being connected by connecting pipe 34 which in turn is connected with a flow line 36. The treating system 10 is incorporated into the pipes 30 and 32 and includes a unit such as is illustrated in FIGS. 1–4 and which include parallel pipes 38 and 40 which are connected to pipes 30 and 32 respectively with the connecting pipe 34 being connected thereto with the connecting pipe 34 including fittings and couplings in order to provide a tee coupling 42 at the center thereof for connection with the flow line 36.

Supported centrally between the pipes 38 and 40 and slightly in elevated relation thereto is a mixing vessel 44 which may conveniently be a piece of well casing with the two ends of the vessel being rigidly connected to the pipes 38 and 40 by supporting plates 46 which may be welded to the mixing vessel 44 and the pipes 38 and 40 respectively.

Extending upwardly from the pipe 38 and rigid therewith is a pair of parallel standpipes 48 and upstanding from the pipe 40 is a pair of similar standpipes 50. The upper ends of the standpipes 48 are connected by a pipe 52 and the upper ends of the standpipes 50 are connected by a pipe 54 in which the pipes 52 and 54 are parallel to each other and the standpipes 48 and 50 are also parallel to each other with the standpipes being maintained in parallel relation by transverse pipes or braces 56. This structure provides a rigid supporting stand for a supply tank or reservoir 58 which may be in the form of an oil drum of 55-gal. capacity which is readily available in the industry, and the drum is supported by the cross members or braces 56 and the parallel side pipes or rails 52 and 54 as illustrated in FIG. 1 with the end of the tank or reservoir 58 remote from the well including a discharge spigot 59 having a shut-off valve 60 therein for discharging chemical additive from the supply tank or reservoir 58.

Supported in underlying relation to the spigot 59 is a calibrated measuring container 62 having a discharge pipe 64 communicated with the bottom thereof and extending into the mixing vessel 44 so that the discharge pipe 64 being rigid with the vessel 44 and the measuring container 62, the measuring container 62 will be securely supported in position below the spigot 59. The measuring container 62 is provided with a removable top closure 66 and the discharge pipe 64 is provided with an unloading valve 68 so that when a predetermined quantity of chemical additive has been discharged into the calibrated measuring container 62 from the supply tank 58 through the spigot 59, the shut-off valve 60 is closed and the unloading valve 68 may be opened thus gravity draining the chemical additive into the mixing vessel 44.

The mixing vessel 44 and the pipe 32 are communicated through a bypass line 70 having a bypass valve 72 therein with the bypass line 70 extending into the upper end portion of the horizontally disposed cylindrical mixing vessel 44. The lower portion of the same end of the mixing vessel 44 is communicated with the pipe 38 through a bypass line 74 having a bypass valve 76 therein. The bypass line 74 also includes a combined drain and relief valve 78 by virtue of which the contents of the mixing vessel may be completely drained and the relief valve will prevent excessive pressure occurring in the mixing vessel.

Downstream from the bypass line 70, the pipe 32 is provided with a manual valve 80 and a check valve 82 while the line 38 is provided with a manual valve 84 and a check valve 86 downstream from the bypass line 74. The casing valve 82 and the production tubing valve 84 are normally open and the two bypass valves 72 and 76 are normally closed when the system 10 of the present invention is not in use so that flow from either the tubing pipe 30 or the casing pipe 32 proceeds to the flow line 36.

When chemical treatment is desired, the desired quantity of chemical additive is discharged into the measuring container which may have any suitable means of calibration such as graduated indicia on the inside surface or any other suitable indicating means to indicate a particular quantity of chemical additive. The additive may be discharged into the mixing vessel 44 by opening the valve 68 and after the measured quantity of additive material has been placed in the mixing vessel 44, the valve 68 may be closed and the bypass valves 72 and 76 opened when the casing and tubing valves 80 and 84 are closed thus circulating fluid through the mixing vessel and mixing the chemical additive with the circulating fluid so that the chemical additive will circulate through the well casing and production tubing and the pump or the equipment at the bottom of the bore hole. This circulation may be continued for a desired period of time after which the bypass valves 72 and 76 may be closed and the casing valve 80 and tubing valve 84 opened for again pumping the well in a normal manner.

The standpipe 48 remote from the well is in fluid communication with the tubing pipe 30 and is provided with a pressure gauge 88 associated therewith and the standpipe 50 in alignment therewith is in communication with the casing pipe 32 and is provided with a pressure gauge 90. The pressure gauges 88 and 90 enable continuous visual monitoring of the pressure conditions in the production tubing string 14 and the casing 12 in the bore hole. Suitable recording or logging equipment may be associated with the standpipes if desired.

The end of the mixing vessel adjacent the well is provided with a pair of valved pipes 92 and 94 which may be connected to a pressure pump for circulation through the mixing vessel which may be necessary in certain installations. In other words, a pressure chemical pump may be connected into the mixing vessel if desired.

The shape and configuration of the supply tank or reservoir 58 may be varied depending upon each installation requirement and with a permanently mounted tank as provided on the stand, the measuring container may be provided with a pipe line communicated with the supply reservoir with the pipe line including a suitable valve, thus enabling a closed measuring container to be employed thereby further reducing any possible injury to personnel by providing a completely closed system.

Figure 6:
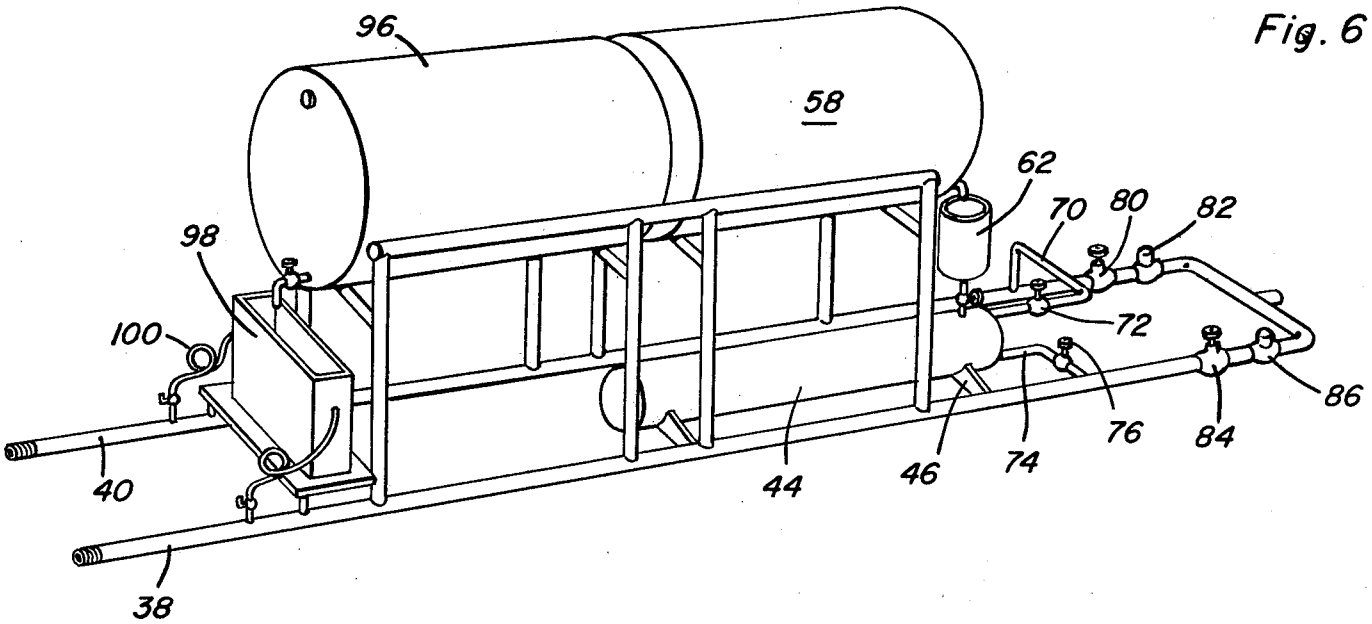
FIG. 6 is a perspective view illustrating a modified form of the present invention.

FIG. 6 illustrates a modified form of the invention in which the supporting stand structure is increased in length and a second supply tank or reservoir 96 is supported thereon containing a supply of emulsion breakers for discharge into a measuring tank 98 which is in communication with the pipes 30 and 32 through valved tubes 100 thus enabling an emulsion breaker to be injected into the flow lines when desired. The remainder of the structure remains the same as that illustrated in FIGS. 1–5.

Figure 7:
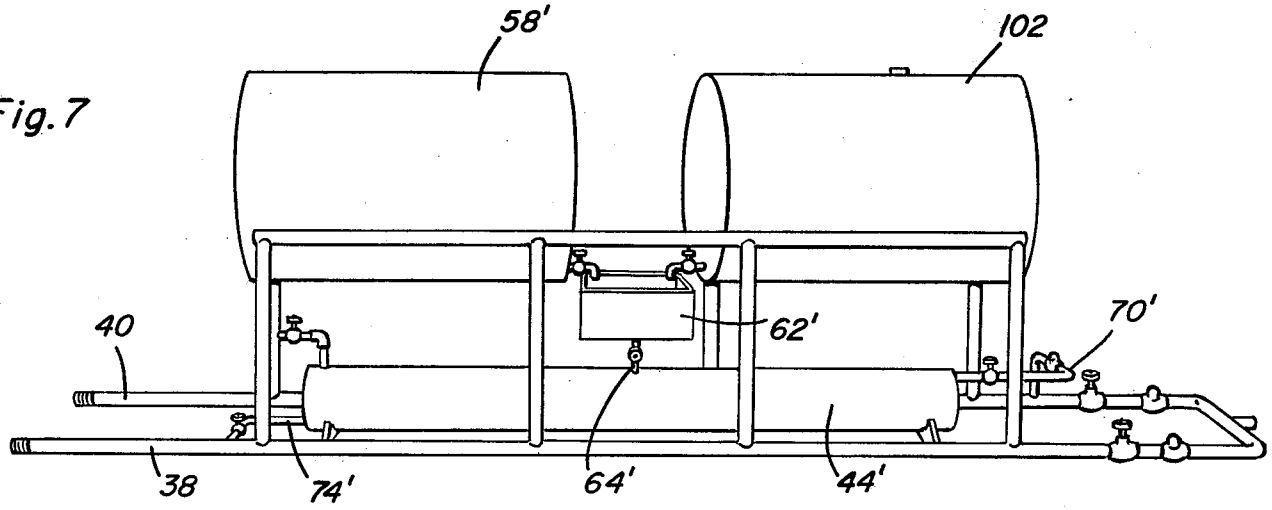
FIG. 7 is a perspective view illustrating another modified form of the invention.

FIG. 7 illustrates a modified arrangement similar to that in FIG. 6 in which an elongated stand is provided but in this arrangement, the supply tank or reservoir for chemical additive to prevent corrosion is oriented at the end of the stand adjacent the well and designated by numeral 58'. A second tank 102 is supported at the other end of the stand and both of the tanks discharge into a measuring tank 62' that is communicated with the center of a mixing vessel 44' through a valved discharge pipe 64'. In this arrangement, the bypass line 72' is at one end of the stand and the bypass line 74' is at the other end. This enables a second additive material such as a paraffin remover to be added to the mixing vessel and to the flow lines when desired.

During normal pumping, the valves 80 and 84 are open and valves 72, 76 and 78 as well as valve 68 are closed. For corrosion treatment of the down casing, the well is shut down and the valves 68, 72, 76, 80 and 84 remain closed and drain valve 78 is opened to bleed off pressure and then subsequently closed. The drum 58 is then opened and a measured amount of chemical additive is permitted to run into the measuring container 62. After a measured quantity of chemical additive has been placed in the measuring container 62 and the shut-off valve 60 closed, the valve 68 is then opened to release the measured quantity of chemical into the mixing vessel 44. The valve 68 is then closed and the pumping operation is commenced with valve 72 then opened and subsequently valve 76 is opened with the mixing vessel being so contructed that fluid coming in will flush all chemical down the well. Low volume wells can be left circulating over night and high volume wells will flush the mixing vessel very quickly. After the mixing vessel has been flushed and the fluid circulated for a desired period, valves 80 and 84 may be opened and valves 72 and 76 closed so that the pumping operation continues normally.

In order to check the pump action, valves 72 and 78 may be opened while valves 80, 76 and 68 are closed. This will also enable a pressure gauged test. A hot oil flow line may be connected to the drain valve 78 for circulating hot oil in relation to the well by appropriate valve manipulation.

While the multiple tank arrangements in FIGS. 6 and 7 illustrate the tanks in line, a second tank can be supported by a stand alongside tank 58 with a hose or other conduit connected with measuring container 62. Also, the measuring container 62 may be in the form of a vented horizontal tank paralleling mixing vessel 44.

The treating system may be used as a manifold in new wells and can be installed in communication with old wells in a relatively short time by employing readily available components. The device is primarily useful for chemical treatment of oil wells but may be used for various other purposes for treating oil wells, monitoring the conditions therein and for many other purposes in which the unit is assembled in a remote relation to the well head assembly and pumping apparatus.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An oil well treating system in which the oil well includes a casing in the bore hole and a production tubing string in the casing, said system comprising a pipe communicated with the upper end of the production tubing string and a pipe communicated with the upper end of the casing, said pipes extending away from the oil well and disposed in spaced relation, a stand rigidly interconnecting said pipes and extending above the pipes, a supply tank for chemical additive supported by said stand, a measuring container supported by said stand below the supply tank for receiving a predetermined quantity of chemical additive therefrom, a mixing vessel supported from said stand below the mixing container and communicated therewith, said mixing vessel being disposed above said pipes, a bypass line extending from each of said pipes to said mixing vessel with valves in each of the bypass lines to enable circulation of fluid through the mixing vessel and pipes for flushing chemical additive in the mixing vessel into the oil well for treating down hole equipment in the well.

2. The structure as defined in claim 1 wherein each of said pipes includes a valve disposed therein, the bypass line in each of said pipes lying between the valve and the oil well, the structure further comprising interconnection means connecting said pipes, the valves being disposed in the pipes between said bypass lines and said interconnection means, and a flow line communicating with said pipes at the interconnection means, the flow line communicating with a storage area for production fluid.

3. The structure as defined in claim 2, wherein said stand includes a pair of vertical standpipes rigid with each of said pipes, longitudinal members interconnecting the upper ends of the upstanding pipes and transverse members interconnecting said upstanding pipes to form a rigid stand, said supply tank being in the form of a drum resting horizontally on the upper end of the stand.

4. The structure as defined in claim 3, wherein said pipes communicated with the casing and tubing string respectively are disposed in generally horizontal supporting engagement with the ground surface.

5. The structure as defined in claim 4, together with a second tank for additive material supported on said stand and being oriented for discharging a measured quantity of material in the measuring container.

6. The structure as defined in claim 4, together with a second supply tank for additive material supported on said stand, a second measuring container receiving additive material from the second supply tank, and valved tubing connectors communicating the second measuring container with the pipes.

7. The structure as defined in claim 4, wherein the bypass lines are connected to the upper and lower portion of the mixing vessel, the bypass line communicated with the lower portion of the mixing vessel including a drain and relief valve therein to enable the pressure in the mixing vessel to be released prior to introduction of chemical additive from the measuring container and to enable material to be drained from the mixing vessel or injected into the mixing vessel.

8. A device for injecting a quantity of additive into a fluid flow line comprising a pair of spaced pipe sections incorporated into a flow line and providing a flow path, a mixing vessel supported adjacent the pipe sections, bypass conduits connecting the pipe sections to the vessel, each bypass conduit including a valve to selectively communicate the vessel with the pipe sections, each pipe section including valve means to close at least one of the pipe sections and divert flow through the bypass conduits and the mixing vessel, and means supplying a predetermined quantity of additive to the mixing vessel when the bypass conduit valves are closed, the last-mentioned means including a measuring container having a gravity discharge to the mixing vessel, a valve in said gravity discharge, and a vent in said mixing vessel to exhaust said mixing vessel when the bypass conduit valves are closed, thereby enabling gravity discharge from the container to the vessel.

9. The structure as defined in claim 8 wherein each of said pipe sections includes at least one upstanding support member, connecting members between said support members to form a supporting stand, said mixing vessel and measuring container supported from said stand, said stand including means adapted to support a supply tank for additive for gravity discharge into the measuring container.

* * * * *